United States Patent [19]

Fontan

[11] Patent Number: 4,485,893

[45] Date of Patent: Dec. 4, 1984

[54] APPARATUS FOR EMERGENCY EVACUATION OF PEOPLE FROM TALL BUILDINGS

[76] Inventor: Nestor R. Fontan, Del Libertador 4854, Buenos Aires, Argentina, 1426

[21] Appl. No.: 466,635

[22] Filed: Feb. 15, 1983

[30] Foreign Application Priority Data

Feb. 23, 1982 [AR] Argentina ..... 288522

[51] Int. Cl.[3] ..... A62B 1/02

[52] U.S. Cl. ..... 182/234; 182/239; 182/82

[58] Field of Search ..... 182/234, 239, 82, 36, 182/37, 3, 7, 9

[56] References Cited

U.S. PATENT DOCUMENTS

| | | | |
|---|---|---|---|
| 825,506 | 7/1906 | Barsalon | 182/239 |
| 3,410,364 | 11/1968 | Fountain | 182/9 |
| 3,944,021 | 3/1976 | Smith | 182/36 |
| 4,121,689 | 10/1978 | Bonvin | 182/3 |
| 4,295,543 | 10/1981 | Graham | 182/3 |
| 4,406,349 | 9/1983 | Vilcheck | 182/82 |

*Primary Examiner*—Reinaldo P. Machado
*Assistant Examiner*—Alvin Chin-Shue
*Attorney, Agent, or Firm*—Holman & Stern

[57] ABSTRACT

An apparatus for emergency evacuation of people from tall buildings having a sliding descent device for removably coupling to a vertical guide column fixed to an exterior wall of the building, a speed of descent regulating device, and a support beam for attaching to and supporting a person.

5 Claims, 6 Drawing Figures

APPARATUS FOR EMERGENCY EVACUATION OF PEOPLE FROM TALL BUILDINGS

BACKGROUND OF THE INVENTION

1. Field of the Invention

The invention relates to an apparatus for emergency evacuation of people from tall buildings, particularly in incidents of fire, leakage of toxic gases, etc., when the building exits are apt to be blocked by fire and smoke during the emergency.

2. Description of the Prior Art

The object of the present invention is to devise an apparatus for avoiding the tragic consequences which are produced during emergencies in tall buildings when, as has been experienced in disasters under these circumstances, it is not possible to use the fire escapes, since typically the entrances to the stairs and fire escapes and to the building exits are blocked by smoke and flames, thereby inducing inappropriate panic reactions in the people prevented from exiting, with well known tragic results. The use in these cases of telescopic mechanical ladders has also been found to be ineffective due to their limited reach and also due to the likelihood of their being exposed to flames at any given time.

The panic which spreads among the occupants of a tall building when they learn of a fire is well known, particularly with regard to people located in the top floors of the building who, when they find themselves isolated due to the emergency exits being blocked as mentioned supra, attempt to reach a terrace, landing, or ledge, and once there, not finding any appropriate means for their evacuation, throw themselves off the building, agitated by desperation or fear of death.

There have been attempts to solve this type of problem by building escape apparatus or means into the structure of the building, but for various reasons these have not given efficient results. Accordingly, the known types of internal and external emergency stairways and ladders have survived over the years. Due to the drawbacks mentioned, these leave the occupants in danger and in need of rescue under the adverse circumstances of a fire or similar emergency.

SUMMARY OF THE INVENTION

With the aim of rapidly evacuating people in tall buildings, the present invention offers an apparatus with a simple structure, for personal use, which permits the occupants to slide down on a vertical column, by gravity force, at a controlled speed.

According to the invention, a series of devices will be installed on different floors of the building and on the terraces, at appropriate locations, which devices extend the reach of the occupants such that, as soon as an emergency (e.g., fire) develops, each person has available an individual means of escape which permits him, in a simple operation, to hitch himself to a column (i.e., any of a number of columns) attached to the exterior wall of the building at a strategic location near a window sill or ledge. The plurality of columns of this type do not substantially alter the appearance of the building (from an esthetic standpoint), and they permit the occupants to slide down; i.e., they permit total, ordered evacuation in a relatively short time.

The apparatus proposed is easily transportable by one person. It is comprised essentially of an arm having a head piece at one end, which head piece is adaptable to or shaped to fit a column fixed to the wall of the building, to form a cantilevered link for suspending the user. At the other end of the arm a harness, belt, or small chair is attached thereto, upon which the user mounts before proceeding to attach the arm to the column.

The head piece has opposing surfaces which correspond to (match) surfaces, guide ways, or tracks for sliding, on the column, and said head piece further comprises means of engagement with a rack on the column, and means of regulation or control of the speed of descent, said latter means comprising, e.g., a centrifugal governor the weights of which are in the form of friction shoes which act on the surface of a drum fixed to the head piece to enable the speed of descent to be controlled.

In accordance with the preceding, the combination of arm and column described permits a person of any weight to jump or be evacuated in a very short time, and to leave the building without difficulty, by means of simple descent along the column, thereby satisfying one of the essential conditions for evacuation methods in an emergency such as a fire, namely to avoid lost time in order to avoid exposure to serious hazards.

The device component (portable component) of the apparatus is simple to handle and operate and relatively light, in order to facilitate coupling to the column. Its dimensions are minimal, and appropriate for its easy use by people of various sexes and ages. The device includes means of locking it in position relative to the column, and means of automatic starting, thus enabling it to be hooked up to and locked onto the column by merely bringing it up to the column and placing it against said column, whereby in the process a pinion which is an element of the device becomes meshed with the rack on the column.

The harness or belt should be affixed prior to hooking up the device to the column, and the person can then jump or be pushed off of the building and descend without fear, since the speed is controlled to moderate the force of gravity and retard the fall.

Thus, the present invention proposes an apparatus for emergency evacuation of people from tall buildings, particularly in case of fire accompanied by blocking of building exit ways by flames and smoke; characterized by a sliding descent device comprising a permanently attached harness or belt for suspending the user, means of coupling said device to a vertical column fixed to the exterior wall of the building in question, means of regulating the speed of descent, and means of locking said device in position relative to the column.

The invention also encompasses other accessories which will be discussed.

BRIEF DESCRIPTION OF THE DRAWINGS

For the sake of clear understanding and easier reduction to practice of the invention, the following drawings are offered, which represent, for purposes of example, one of the preferred embodiments wherein.

Figures 1, 2, 3:
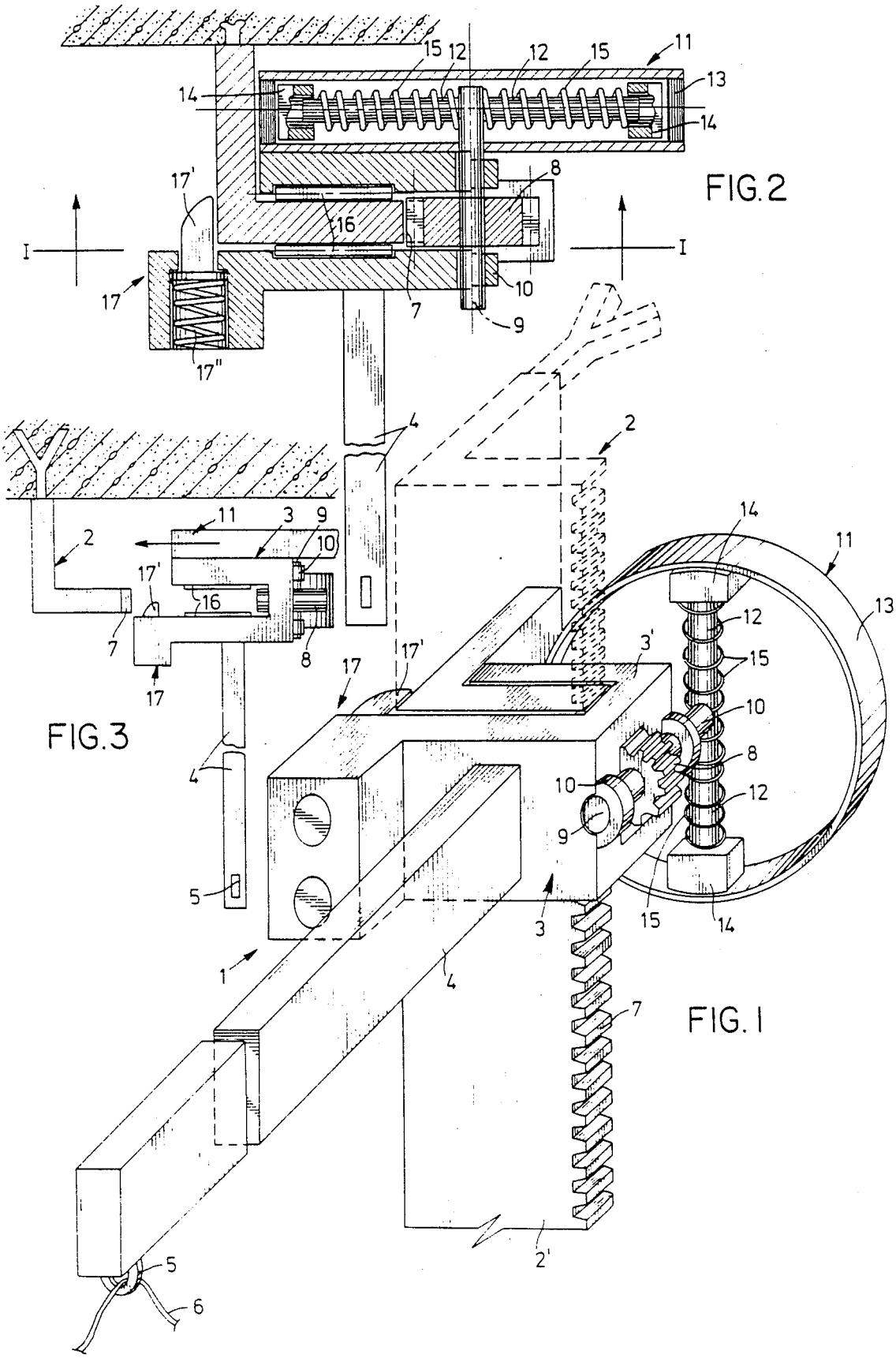
FIG. 1 is a perspective view of the inventive apparatus.
FIG. 2 is a cross-sectional plan view of the apparatus, showing its component elements.
FIG. 3 is another plan view, showing the form of the mounting of the user suspension device on the column.
Figure 6:
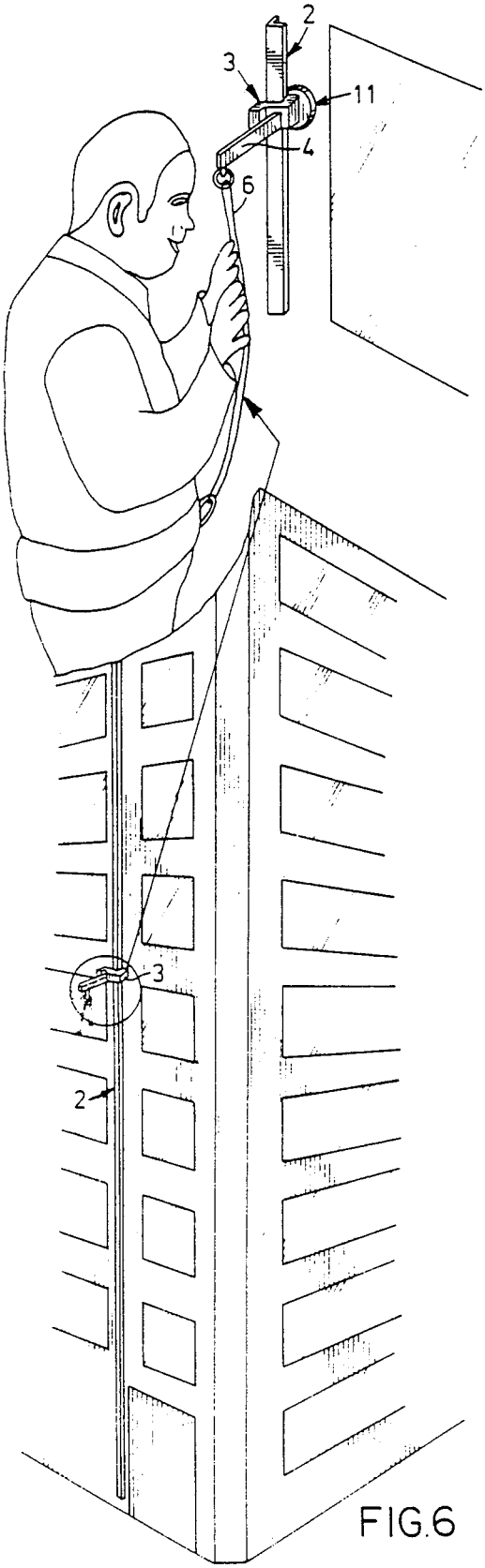
FIG. 6 is a view of the apparatus mounted on a building, and a detail of said view in which the position occupied by the user is shown.
Figure 4:
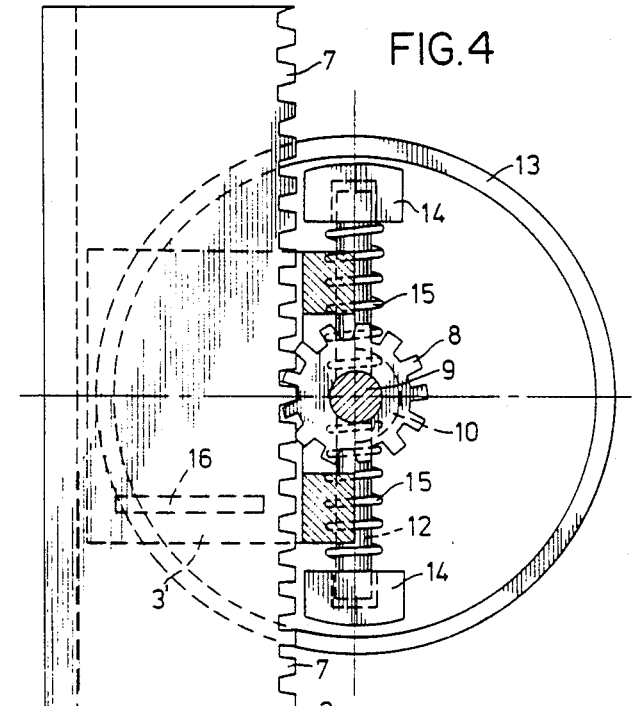
FIGS. 4 and 5 are cross-sections through the line I—I of FIG. 2, showing the device in the position in which it is inoperative or beginning its descent (FIG. 4), and in a displaced position (FIG. 5)
Figure 5:
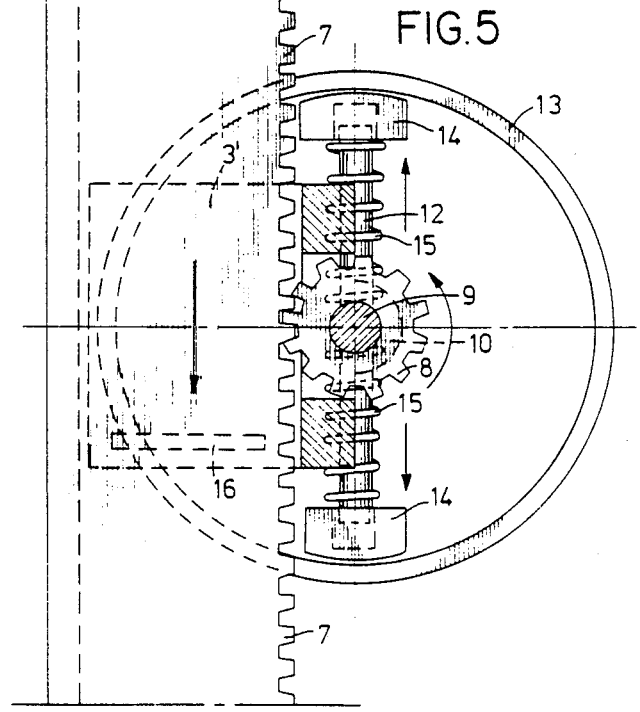

In all the abovementioned Figures, reference numerals of like value indicate parts which are identical or corresponding.

DESCRIPTION OF THE PREFERRED EMBODIMENTS

In a preferred embodiment as represented by the Figures, the invention comprises a device 1 for suspension or support of the user, and a column 2 for guiding device 1 and enabling it to slide down.

Device 1 is comprised of a head piece 3 having a bar or arm 4 projecting out from it in cantilever fashion, said arm having a cross-section appropriate for supporting persons of different weights without difficulty.

Arm 4 as shown has a rectangular shape. A harness or belt 6 is attached to its free end 5, for the user to secure his or her body.

The user may simply place the harness or belt 6 around his waist, with said harness or belt being attached to the end 5 of arm 4, for the sake of simplicity and speed when the user is going to jump or be pushed off the building.

The head piece 3 as shown is comprised of a U-shaped piece 3' which is rigidly attached to the arm 4. The free space between the branches of piece 3' is slightly greater than the width of the side leg 2' of the column 2. The opposite side surfaces of said side leg 2' remain against the interior surfaces of the U-shaped piece 3' when the head piece 3 is engaged on the column, whereby said opposite surfaces of side leg 2' form respective guide ways for the head piece 3 to slide down.

The column 2 as shown has an L-shaped cross-section; other shapes are possible. What is essential is that it have two guide surfaces for the head piece 3 to slide down.

The column 2 extends vertically over the exterior surface of the building, at a distance from the windows which makes it readily accessible but still far enough away (from the edge of the windows) so that the fire cannot reach it and so that the device 1 can be attached to it with no effort. The lower end of column 2 is a convenient distance above the ground to permit disengagement of the device, and the column 2 is fixedly attached to the building by conventional means.

The column 2 additionally has a rack 7 extending over its entire length, and the head piece 3 has a pinion 8 in its central branch, which pinion is fixedly mounted on axle 9 so as to rotate with the axle freely around axle 9 being disposed transversely to the column 2 and rotatably supportively mounted in head piece 3 by corresponding bearings 10. The pinion 8 becomes engaged with the rack 7 when the user attaches or hooks up the head piece 3 on the column 2 by moving it in the direction indicated by the arrow in FIG. 3.

The end of the axle 9 of the pinion 8 is connected to a mechanism which governs the speed of descent (by gravity force) of the user; this mechanism may be, e.g., a centrifugal-type governor 11.

The governor 11 shown is comprised of at least one pair of bars 12 fixed to the axle 9 and extending radially within a drum 13 which is fixed to the head piece 3 of the device 1, and is further comprised of corresponding weights 14 mounted on said bars 12 so as to be freely slidable over said bars and connected to corresponding springs 15 disposed coaxially with said bars 12, said springs being in a mode such that when the apparatus is stationary they draw the weights 14 toward the center of the drum 13 by spring tension.

The head piece 3 has, on its surfaces which face the side surfaces of the side leg 2' of the column 2, respective bearing elements 16 mounted at points which are vertically displaced, to keep the head piece 3 from catching when the user is suspended from the device. This arrangement provides bearings without certain drawbacks which are otherwise encountered.

The head piece 3 has, on its branch opposite to the branch to which the drum 13 of the governor 11 is attached, a means 17 for locking the head piece 3 with respect to the column 2. In the embodiment shown, this locking means is in the form of a latch 17' which projects out behind the rear surface of the frame of the head piece 3 and which has a slanting end which causes it to retract during the mounting of the head piece 3, until the point where the head piece reaches a meshed position between the pinion and rack, at which point the latch 17' is freely displaced by means of spring means 17'' and moved into an engaged (locking) position against the rear part of the column 2.

It is important that the distance between the latch 17' and the center branch of the head piece 3 be equal to the width of the side leg 2' of the column 2 in order to permit the pinion 8 to mesh with the rack 7.

The operation or use of the apparatus described is simple, and is described as follows:

The user (or building occupant) in case of fire goes immediately to the location of the device 1, which is kept in a strategic location from the standpoint of fire conditions and circumstances. The devices need no maintenance or periodic inspection and can be used under any circumstances without being dependent on a source of energy or on climatic conditions.

The user then inserts his body in the belt or harness 6, which is permanently attached to the free end 5 of the arm 4 lest, out of nervousness, the user leave it behind, with fatal results.

Once the user is in the harness or belt 6, he proceeds to properly hook up the head piece 3 to the column 2, as indicated in FIG. 3, by bringing the head piece face to face up the column 2 and pressing it against the latter, causing the retraction of the latch 17', which latch then slides over the surface of the side leg 2' of the column 2 until it reaches the rear part of said side leg, where, by the action of the spring means 17'', it emerges and locks.

At this point the pinion 8 meshes with the rack 7, stopping and holding the device 1 with respect to the column 2, with the user being held by means of the barness or belt 6 to the arm 4.

Once the device is positioned as described, the user may jump or be pushed off the building, whereby gravity will force the device to descend, whereupon the pinion 8 will rotate, causing the radial bars 12 of the governor 11 to rotate along with it, which in turn will cause centrifugal displacement of the weights 14 outward along the bars 12, so that eventually depending on the weight of the person, the weights will make contact with the internal surface of the drum 13, resulting in regulation of the speed of the device 1. In this way it is possible automatically to control the speed of descent, independently of the weight of the user, bringing about a descent without danger of serious injury.

A mechanical alarm can be incorporated in the device 1 which will advise a person on the next lower floor that another person is descending from above. In this way, problems in the order of descent during the emergency are avoided. Also, the alarm serves as a general warning of the emergency.

The invention has been clearly disclosed hereinabove, and requires no further description.

It is evident that various modifications of the structure and features of the preferred embodiment can be introduced without departing from the scope of the present invention.

I claim:

1. An apparatus for emergency evacuation of persons from buildings having outside walls comprising:

a guide column in the shape of an L-beam attached to the outside wall of the building and extending substantially vertically from a position adjacent ground level to a height sufficient to be reached by any persons occupying the building at the highest level, one outer leg of the L-beam extending substantially parallel to said outside wall in spaced relationship thereto to provide an open channel between said outside wall and said parallel extending leg, for substantially the full length of the L-beam;

a gear rack on the outer edge of said parallel extending leg remote from the other leg of the L-beam;

a carriage removably mountable onto said guide column for sliding relationship thereon comprising;

a substantially U-shaped member having two spaced parallel legs connected at one end by a web and open at the other end to provide a slot between said parallel legs having a width slightly greater than the horizontal cross-section thickness of said outer leg of said guide column to slidably receive said outer leg therein, a shaft rotatably mounted on said carriage with its axis of rotation extending substantially perpendicular to said parallel legs, a pinion gear fixedly mounted on said shaft for rotation therewith and operatively engageable with said rack when said carriage is mounted on said guide column, a descent speed centrifugal governor operatively connected to said shaft and disposed partly in said channel, a user support beam member extending from said U-shaped member in a direction substantially oppositely from said channel when said carriage is mounted on said guide column having an outer end remote from said outer wall of the building, means adjacent the outer end of said support beam for removably attaching a person to the beam, and a releasable retaining means on said U-shaped member for operatively slidably engaging the edge of said parallel leg on said L-beam opposite said gear rack to retain said U-shaped member on said L-beam with said pinion gear engaging said rack when said carriage is mounted on said guide column.

2. The apparatus as claimed in claim 1 wherein said centrifugal governor comprises:

two rod shaped bars fixedly mounted at their inner ends on said shaft and extending radially and equidistantly from the axis of rotation thereof;

a weight freely radially slidable on each bar having a radially outer drum engaging surface;

a drum member mounted on said U-shaped member having a circular inner surface concentric with the axis of rotation of said shaft and positioned to be engageable by said outer drum engaging surfaces of said weights; and a spring member attached to each weight and operatively mounted on said bars to resiliently retract said weights radially inwardly;

so that when said carriage is mounted on said guide column and a person is suspended from said support beam, the speed of rotation of said bars and weights caused by rotation of the shaft driven by said pinion gear meshing with said gear rack drives said weights radially outwardly and the outer drum engaging surfaces thereon into frictional sliding engagement with said inner circular drum surface to control the speed of descent.

3. The apparatus as claimed in claim 2 and further comprising:

flat bearing elements on the inner facing surfaces of said legs of the U-shaped member for sliding engagement with the outer parallel surfaces of said outer parallel leg of the L-beam.

4. The apparatus as claimed in claim 3 wherein:

said shaft is mounted adjacent the outer surface of said web opposite to said slot in the U-shaped member and further comprising:

a hole through said web through which said pinion gear extends, and bearings for said shaft mounted on opposite sides of said pinion gear on said U-shaped member.

5. The apparatus as claimed in claim 4 wherein said releasable retaining means comprises:

a latch member slidably mounted on said U-shaped member;

a latch spring member operatively mounted on said U-shaped member in engagement with said latch to resiliently urge said latch outwardly in the direction of said slot; and a beveled surface adjacent the outer end of said latch member adapted to engage the outer gear rack edge of said parallel leg of the L-beam when the carriage is in position for mounting on the guide column to cam said latch inwardly against the force of said latch spring member during mounting.

* * * * *